US007213352B2

(12) United States Patent
Tse

(10) Patent No.: US 7,213,352 B2
(45) Date of Patent: May 8, 2007

(54) PAIN-RELIEVING OUTSOLE FOR FOOTWEAR OR HEEL SHOE

(76) Inventor: Kin Ming Tse, P.O. Box 84348, Hunghom Bay Post Office, Hunghom, Kowloon (HK)

( * ) Notice: Subject to any disclaimer, the term of this patent is extended or adjusted under 35 U.S.C. 154(b) by 0 days.

(21) Appl. No.: 10/924,121

(22) Filed: Aug. 24, 2004

(65) Prior Publication Data

US 2006/0042121 A1 Mar. 2, 2006

(51) Int. Cl.
*A43B 13/12* (2006.01)

(52) U.S. Cl. ..... 36/30 R; 36/34 R

(58) Field of Classification Search ..... 36/24.5, 36/28, 29, 30 R, 34 R, 35 R, 35 B
See application file for complete search history.

(56) References Cited

U.S. PATENT DOCUMENTS

| | | | | |
|---|---|---|---|---|
| 2,433,034 | A * | 12/1947 | Edinger | 36/179 |
| 4,342,158 | A | 8/1982 | Mc Mahon | |
| 4,843,741 | A * | 7/1989 | Yung-Mao | 36/114 |
| 5,203,095 | A * | 4/1993 | Allen | 36/27 |
| 5,713,140 | A * | 2/1998 | Baggenstoss | 36/28 |
| 6,393,731 | B1 | 5/2002 | Moua | |
| 6,442,871 | B2 | 9/2002 | Doerer | |
| 6,457,261 | B1 * | 10/2002 | Crary | 36/27 |
| 6,557,271 | B1 | 5/2003 | Weaver | |
| 6,860,034 | B2 * | 3/2005 | Schmid | 36/27 |
| 2003/0131501 | A1 * | 7/2003 | Erickson et al. | 36/127 |

* cited by examiner

*Primary Examiner*—Ted Kavanaugh
(74) *Attorney, Agent, or Firm*—Hamre, Schumann, Mueller & Larson, P.C.

(57) ABSTRACT

This invention is the special sole construction, comprising an upper sole, an internal suspension support, a lower sole, a chamber and a U-support. It is used for the assembly of any shoe construction or footwear. The invention will aid in relief of pains arising from upward stroke against the heel of the foot from the heel of the shoe and generated during walking and standing with a heel shoe. The invention is to transmit the upward stroke from the heel of the shoe to the whole area of the sole of the foot and NOT JUST TO THE HEEL OF THE FOOT; and therefore minimizes and even eliminates the upward stroke against the heel of the foot in such that the wearer of the invention experiences the upward stroke from the heel of the shoe as if he wears the shoe without the heel. Finally, the invention helps prevent ankle pain, knee pain, hip pain and lower back pain.

12 Claims, 5 Drawing Sheets

PAIN-RELIEVING OUTSOLE FOR FOOTWEAR OR HEEL SHOE

CROSS-REFERENCE TO RELATED APPLICATIONS

Not Applicable

STATEMENT REGARDING FEDERALLY SPONSORED RESEARCH OR DEVELOPMENT

Not Applicable

Figure 1:
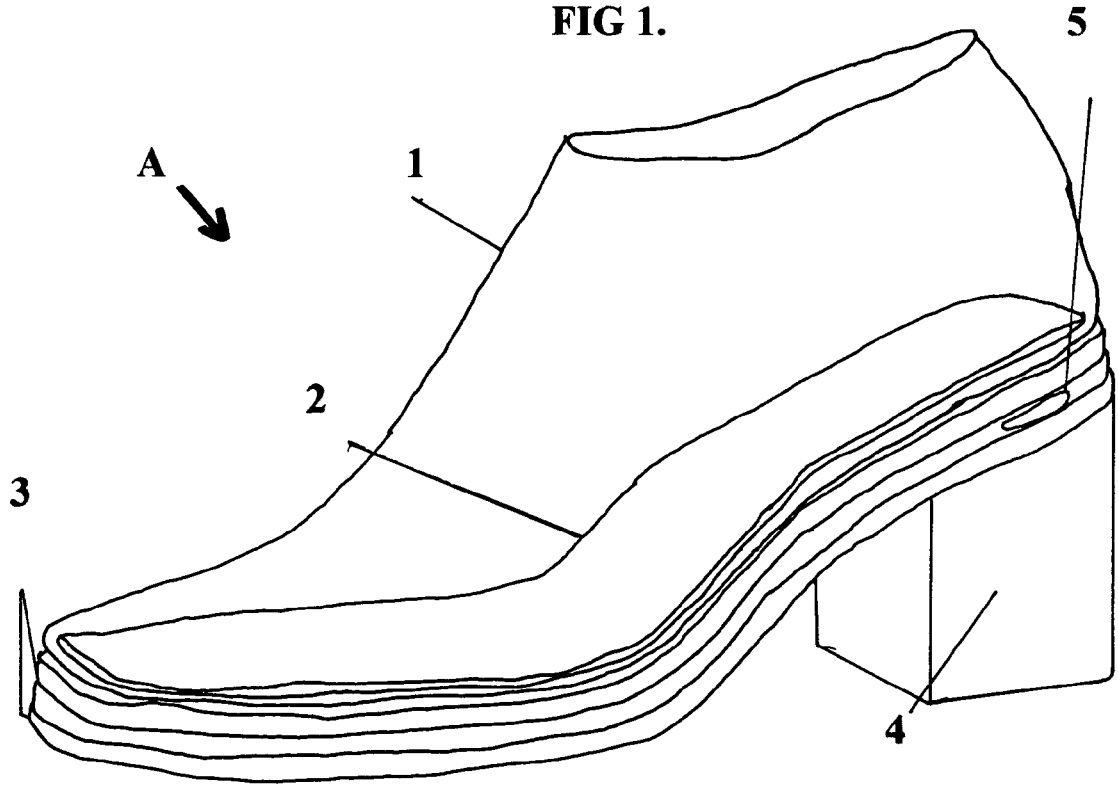

REFERENCE TO SEQUENCE LISTING, A TABLE, OR A COMPUTER PROGRAM LISTING COMPACT DISK APPENDIX

Not Applicable

BACKGROUND OF THE INVENTION

Footwear with heel may lead to upward stroke arising from the stepping of the foot and against the heel of the foot during walking and standing. This upward stroke may run through the ankle, along the foot and leg, pelvic girdle and finally to the backbone. Such upward stroke against the heel of the foot is due to the direct, uttermost and underbeneath contact and pressure touch between the heel of the foot and the heel area of the sole of the shoe.

The upward stroke may cause ankle pain, knee pain, hip pain and lower back pain that are much popular around the world. In addition, wearing footwear with heel or high heel may lead to walking and standing on the foot toe. Such walking and standing on the foot toe causes some fatal symptoms:

a. severe strain on toe joint and finally pain in the toe joint;
b. excessive contraction or even fatigue of muscle around the leg.

There is some device that is to minimize and even eliminate the upward stroke against the heel of the foot. This may be achieved by as follows:

a. the device disconnects or removes the direct, uttermost and underbeneath contact and pressure touch between the heel of the foot and the heel area of the sole of the shoe; in other words, the device provides some isolation between the heel of the foot and the heel area of the sole of the shoe; and therefore,
b. the device distributes the upward stroke evenly over the whole area of the sole of the foot and NOT JUST ONLY THE HEEL OF THE FOOT.

BRIEF SUMMARY OF THE INVENTION

The invention comprises:

a. the lower sole having a bottom surface in contact with the ground and attached with the heel (if any) at the heel area of the shoe;
b. the upper sole having an upper surface onto which the upper structure and the insole are secured and mounted;
c. the internal suspension support which adheres the lower sole and the upper sole except the heel area of the shoe;
d. the chamber located in-between the upper sole and the lower sole, in the heel area of the shoe and adjacent to the internal suspension support; and
e. the U-support to enclose the chamber along the periphery of the heel area of the shoe.

It is noted that the lower sole, the upper sole and the internal suspension support may, for the purpose of manufacturing efficacy and cost consideration, be fused into one structure of the unitary construction from a single piece of molded plastic material.

The internal suspension support adheres and connects the upper sole and the lower sole together except the heel area of the shoe (or, that is, the area to which the heel is attached) so as:

a. to transmit the weight of the body from the upper sole to the lower sole and the heel of the shoe and finally down to the ground;
b. to transmit and distribute evenly the upward stroke from the heel of the shoe through the lower sole and then the upper sole and finally to the whole area of the sole of the foot and NOT ONLY JUST ON THE HEEL OF THE FOOT; and
c. to transmit and distribute the upward stroke from the bottom surface of the lower sole (that is in contact with the ground) through the upper sole to the whole area of the sole of the foot.

BRIEF DESCRIPTION OF THE SEVERAL VIEWS OF DRAWING

The invention may be carried into practice in various ways and will now be described by way of one of the typical examples with reference to the accompanying drawings in which:

FIG. 1 is a side elevation view of the shoe construction A showing an outsole 3, an insole 2, an upper structure 1, a window 5 and a heel 4. It illustrates a shoe construction appropriate to the usual woman's shoe in which a heel is used.

FIG. 1 shows a shoe construction at least employing an outsole 3 mounted on an upper structure 1 which at least partially covers the foot. The upper structure 1 either extends under the foot or terminates at the edge of the outsole 3 and is attached to an insole 2 which is a board with cushion surface. The upper structure 1 is of conventional height to provide adequate room for instep, ankle, toes, arch and heel of the foot or any of them.

In FIG. 1, the outsole 3 may be provided with translucent or transparent windows 5 to render the chamber 9 visible. This translucent or transparent window 5 is desirable for showing a prospective purchaser of the shoe the details of the sole construction.

Figure 2:
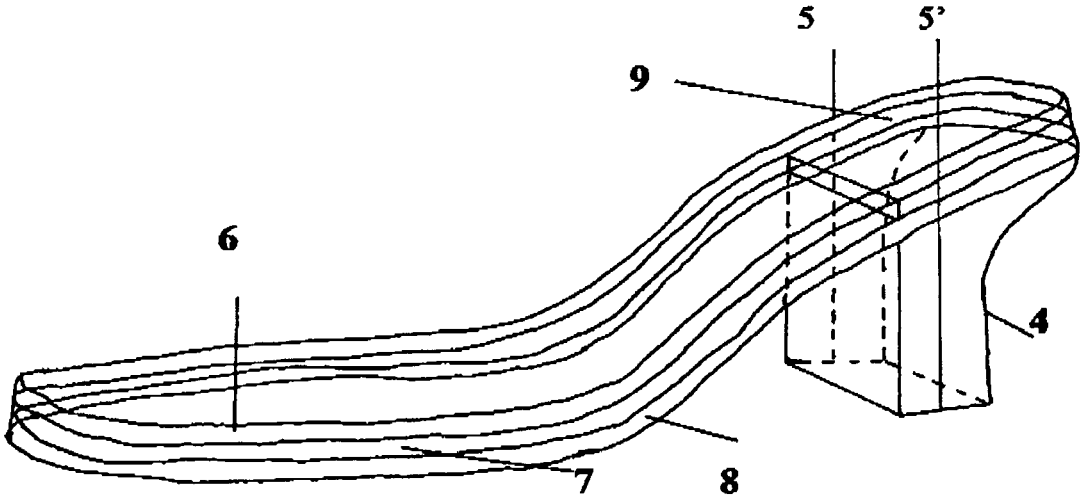

FIG. 2 is a side-elevation view of the outsole 3 which comprises an upper sole 6, an internal suspension support 7, a lower sole 8, and a chamber 9.

FIG. 2 shows the components of the outsole 3: an upper sole 6, an internal suspension support 7, a lower sole 8 and a chamber 9. The upper sole 6, the internal suspension support 7 and the lower sole 8 may be formed of materials having differing characteristics, or of the same material to be fused, because of manufacturing efficacy and cost consideration, together into one structure. The internal suspension support 7 has a height ranging from 0.1 mm to 160 mm and varies in shapes (i.e. starlet, oval, circle or any combination) and areas (i.e. not necessary to completely occupy the forward area and the central area). The internal suspension support 7 may have rectangular, curved or smooth edge for weight enhancement, and is made up of some rigid but cushion-like material.

Figure 3:
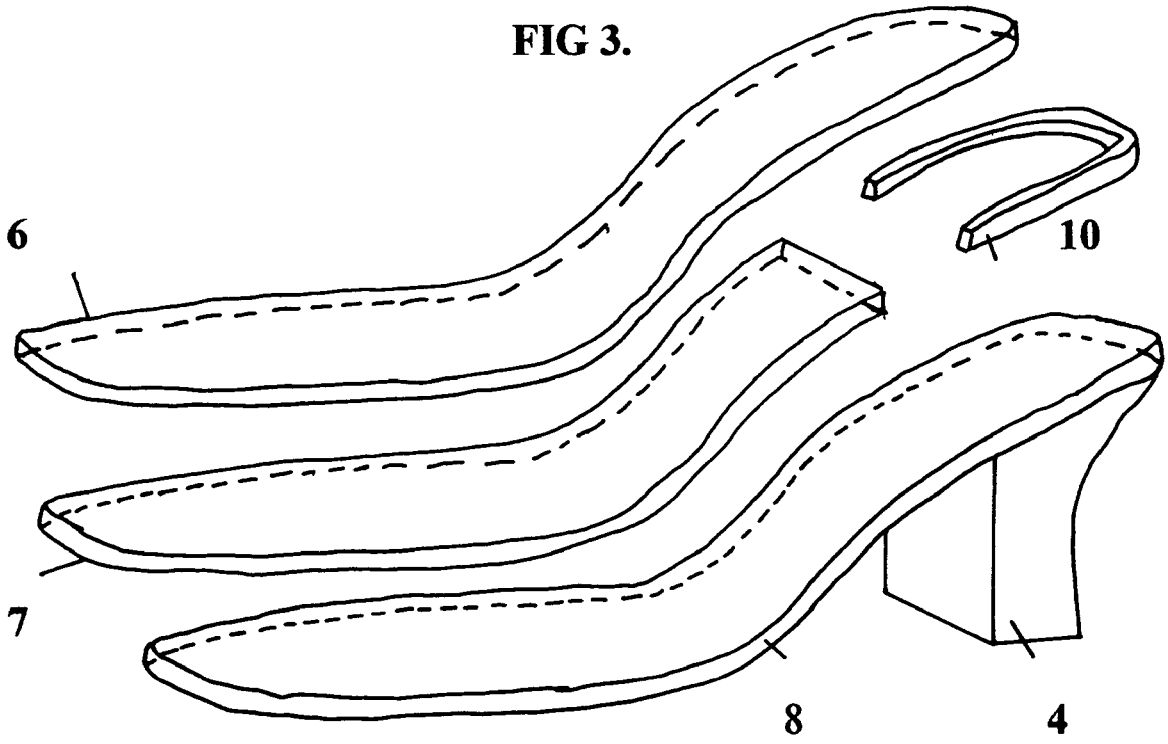

FIG. 3 is a side elevation and dissection view of the outsole 3 which comprises an upper sole 6, an internal suspension support 7, an U-support 10, a lower sole 8 and a heel 4.

As the preferred sole construction, in FIG. 3, the chamber 9 may be enclosed by an U-shaped, tubular support (called as U-support 10) along the periphery of the heel area F of the outsole 3. The U-support 10 forms a wall of the supporting cushion so as to help carry the weight of the body down to the heel 4 of the shoe and to help carry some of the upward stroke imposed by the heel 4 of the shoe to the upper sole 6, the insole 2 and finally the whole area of the sole of the foot (NOT JUST ONLY THE HEEL OF THE FOOT). The U-support 10 is made up of rigid and hard-resisting elastic polymer material. The U-support 10 may be fused, because of manufacturing efficacy and cost consideration, with the internal suspension support 7 to form one structure of unitary construction from a single piece of molded elastic material or etc. It is noted that the U-support 10 is either continuous or of segments.

Figure 4:
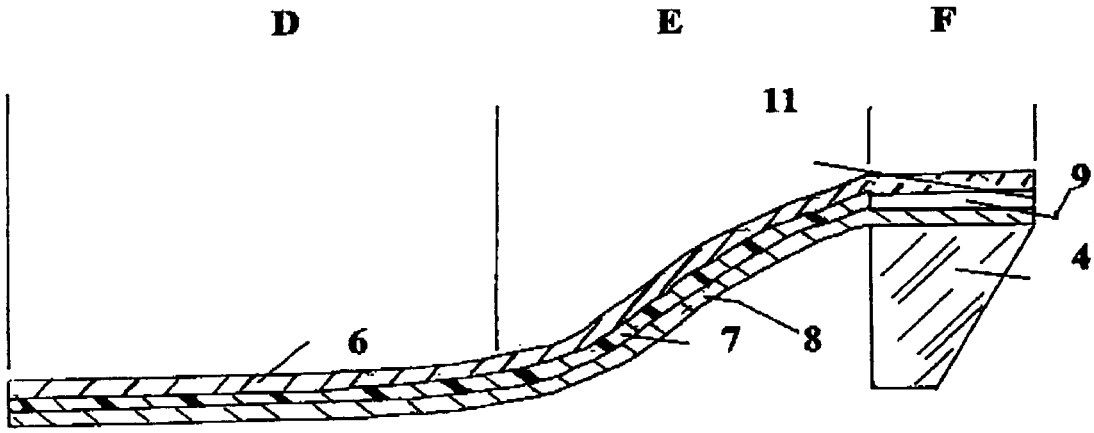

FIG. 4 is a cross-sectional view of the outsole 3 which comprises an upper sole 6, an internal suspension support 7, a lower sole 8, a chamber 9, a covering 11 and a heel 4, and shows the outsole to be divided into 3 areas: forward area D, central area E and heel area F.

Figure 5:
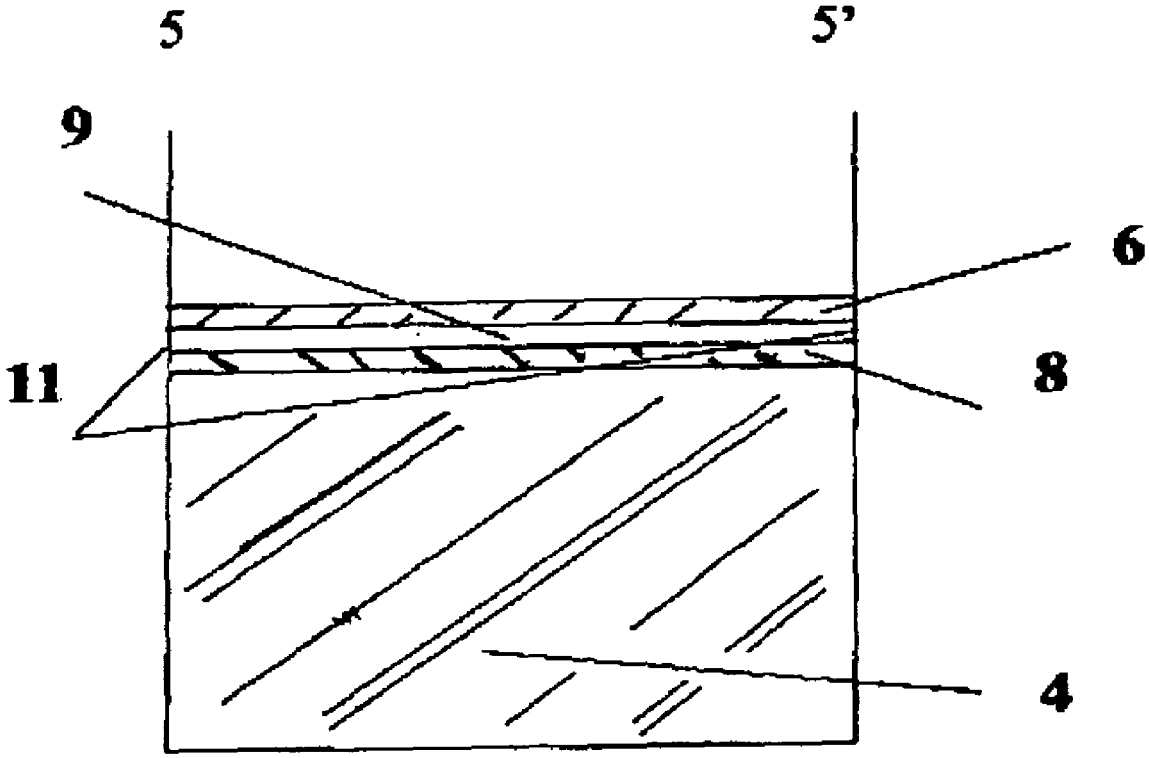

FIG 5 is a cross-sectional view (taken along line 5–5' of FIG. 2) of the outsole 3 which comprises an upper sole 6, a lower sole 8, a chamber 9, a covering 11 and a heel 4.

Any shoe construction or shoe can be divided into 3 areas: forward area, central area and heel area:

Forward Area—the area of the sole that covers from the front of the sole and houses the toe of the foot;

Heel Area—the area of the sole that covers from the rear of the shoe and houses the heel of the foot;

Central Area—the area of the sole that is in-between the heel area and the forward area and houses the arch of the foot.

DETAILED DESCRIPTION OF THE INVENTION

As the footwear with heel is equipped with the invention, upward stroke during and arising from the stepping of the foot during walking and standing runs from a heel 4 firstly, through a lower sole 8 secondly, an internal suspension support 7 thirdly and an upper sole 6 fourthly, and finally distributes evenly over the whole area of an insole 2. However, the three-dimensional shape and geometry of the insole 2 and the unique anatomy of the sole of the foot leads to the preferential contact between the heel of the foot and the heel area of the insole 2 before the complete contact between the sole of the foot and the whole area of the insole 2. The alternative occurrence of the preferential contact and the complete contact spans at the stepping of shoe wearer during walking and standing.

The preferential contact leads to downward pressure resulting from the total weight of the footwear wearer onto the heel area of the insole 2 or, more exactly, onto the heel area of the upper sole 6. Consequently, the heel area of the upper sole 6 exhibits some bending deflection. The bending deflection of the heel area of the upper sole 6 acts as a CANTILEVER. The cantilever has the one end fixed (at the end of the central area of the footwear) and the other end free, and carries a uniformly distributed load of the weight of the footwear wearer. The bending deflection of the heel area of the upper sole 6 pivots at the end of the central area of the footwear and over the chamber and leaves NO UPWARD STROKE to be encountered up to the heel of the foot. The bending deflection of the heel area of the upper sole 6 is to be equal to or greater than 0.1 radium. Evidently, the bending deflection acts like a spring or as a cushion to absorb an upward stroke generated by the weight of the footwearer on the heel of the foot.

As the result, during standing, walking or even slow running, the bending deflection of the heel area of the upper sole 6 will shorten the duration of time of upward stroke generated by the weight of the footwear on the heel of the foot. This ie analogous to the weightlessness of an free-falling object.

As the other result, during standing or walking, most or even all of the upward stroke acted by the upper sole 6, through the insole 2, upon to the sole of the foot will shift to the forward area and the central area of the foot, or even more specifically, to the phalanges and the metatarsals of the foot.

The bending deflection Y can be calculated from the following formula:

$$Y=(4\times L^3\times W)/(E\times b\times d^3)$$

Where W=body weight of the shoe wearer,

L=length of the cantilever, b=breath of the cantilever, d=depth of the cantilever, E=Young's modulus of the material comprising the Cantilever (that is the heel area of the upper sole)

Alternatively, bending deflection is defined as the ratio of the arc length of the angular displacement over the shortest distance of the apex of the upper sole from the point of pivot, where (i the angular displacement is caused by the application of the body weight over the heel area of the upper sole; and (ii) the point of pivot is the point of contact between the anterior end of the internal suspension support and the upper sole.

Moreover, the bending deflection of the heel area of the upper sole depends on THREE-DIMENSIONAL SHAPE, GEOMETRY and DESIGN of the heel area of the upper sole.

In effect, the invention minimizes and even eliminates the upward stroke against the heel of the foot in such that the wearer of the invention experiences the upward stroke from the heel of the footwear as if he have worn the footwear without the heel. It is because:

a. the invention disconnects or removes the direct, uttermost and underbeneath contact and pressure touch between the heel of the foot and the heel area of the sole of the shoe; in other words, the invention provides some isolation between the heel of the foot and the heel area of the sole of the shoe; and therefore, b. the invention distributes the upward stroke evenly over the whole area of the sole of the foot and NOT JUST ONLY THE HEEL OF THE FOOT.

c. the invention shifts most or even all of the upward stroke acted by the upper sole, through the insole, upon to the sole of the foot to the forward area and the central area of the foot, or even more specifically, to the phalanges and the metatarsals of the foot.

It will of course be realized that the above has been given only by way of illustrative example of the invention and that all such constructions thereto as would be apparent to persons skilled in the art are deemed to fall within the broad scope and ambit of the invention as is defined in the appended claims.

What I claim as my invention are:

1. An outsole for footwear or heel shoe comprising:

an upper sole;

a lower sole;

an internal suspension support disposed between the upper sole and the lower sole, the internal suspension support extends from an end of a heel area of the outsole proximate a central area of the outsole and toward a forward area of the outsole;

a support for the heel area disposed between the upper sole and the lower sole and adjacent the internal suspension support, the support for the heel area extends along a periphery of the heel area of the outsole; and a chamber enclosed within an area defined by the upper sole, the lower sole, the internal suspension support, and the support for the heel area.

2. An outsole as in claim 1, wherein said chamber is air-filled so as to have a cushioning effect located in the heel area of the sole.

3. An outsole as in claim 1, wherein said heel area of the upper sole is constructed of an elastic material, the elastic material configured to provide a bending deflection, at the heel area of said upper sole that is equal to or greater than 0.1 radium.

4. An outsole as in claim 1, wherein said chamber is enclosed by the support for the heel area along the periphery of the heel area of the sole for support and cushion.

5. An outsole as in claim 1, wherein the chamber extends from the end of the heel area that is proximate the central area of the outsole, and toward an end of the heel area proximate a back of the heel area.

6. An outsole as in claim 1, wherein the support for the heel area is a U-shaped, tubular support that extends about the periphery of the heel area.

7. An outsole as in claim 1, wherein the support for the heel area forms a wall about the periphery of the heel area, the wall is configured to provide a bending deflection at the heel area of the upper sole, such that the upper sole acts as a cantilever, so as to transmit and distribute ground contact, imposed on the heel area, toward the central area and the forward area of the outsole, and so as to uniformly distribute a weight of a wearer throughout the outsole.

8. An outsole as in claim 1, wherein the support for the heel area is constructed of a rigid and hard-resisting elastic polymer material.

9. An outsole as in claim 1, wherein the support for the heel area is fused with the internal suspension support so as to form a single unitary construction.

10. An outsole as in claim 1, wherein the support for the heel area is a single piece of molded elastic material.

11. An outsole as in claim 1, wherein the support for the heel area is a continuous segment disposed about the periphery of the heel area.

12. An outsole as in claim 1, wherein the internal suspension support continuously extends from the end of a heel area of the outsole proximate the central area of the outsole and to the forward area of the outsole.

* * * * *